United States Patent [19]

Sand

[11] 4,198,637

[45] Apr. 15, 1980

[54] CONTROL FOR AN ELECTRIC MOTOR-DRIVEN TELESCOPING RADIO ANTENNA

[75] Inventor: Roger D. Sand, Kokomo, Ind.

[73] Assignee: General Motors Corporation, Detroit, Mich.

[21] Appl. No.: 925,210

[22] Filed: Jul. 17, 1978

[51] Int. Cl.[2] ..... H01Q 1/32; H01Q 1/10

[52] U.S. Cl. ..... 343/715; 343/903

[58] Field of Search ..... 343/715, 889, 903; 318/266, 267, 467, 468; 325/365

[56] References Cited

U.S. PATENT DOCUMENTS 2,933,597 4/1960 Jensen ..... 343/903

*Primary Examiner*—Eli Lieberman

*Attorney, Agent, or Firm*—Donald F. Scherer

[57] ABSTRACT

A vehicle radio antenna control wherein the extension of the antenna is controlled by the radio on-off switch and the vehicle ignition switch in series, and the retraction of the antenna is controlled by a switch which is actuated in response to the manipulation of a mechanism which protects the vehicle from unauthorized entry, such as a door lock, when either or both ignition switch and radio on-off switch are in the off position.

1 Claim, 1 Drawing Figure

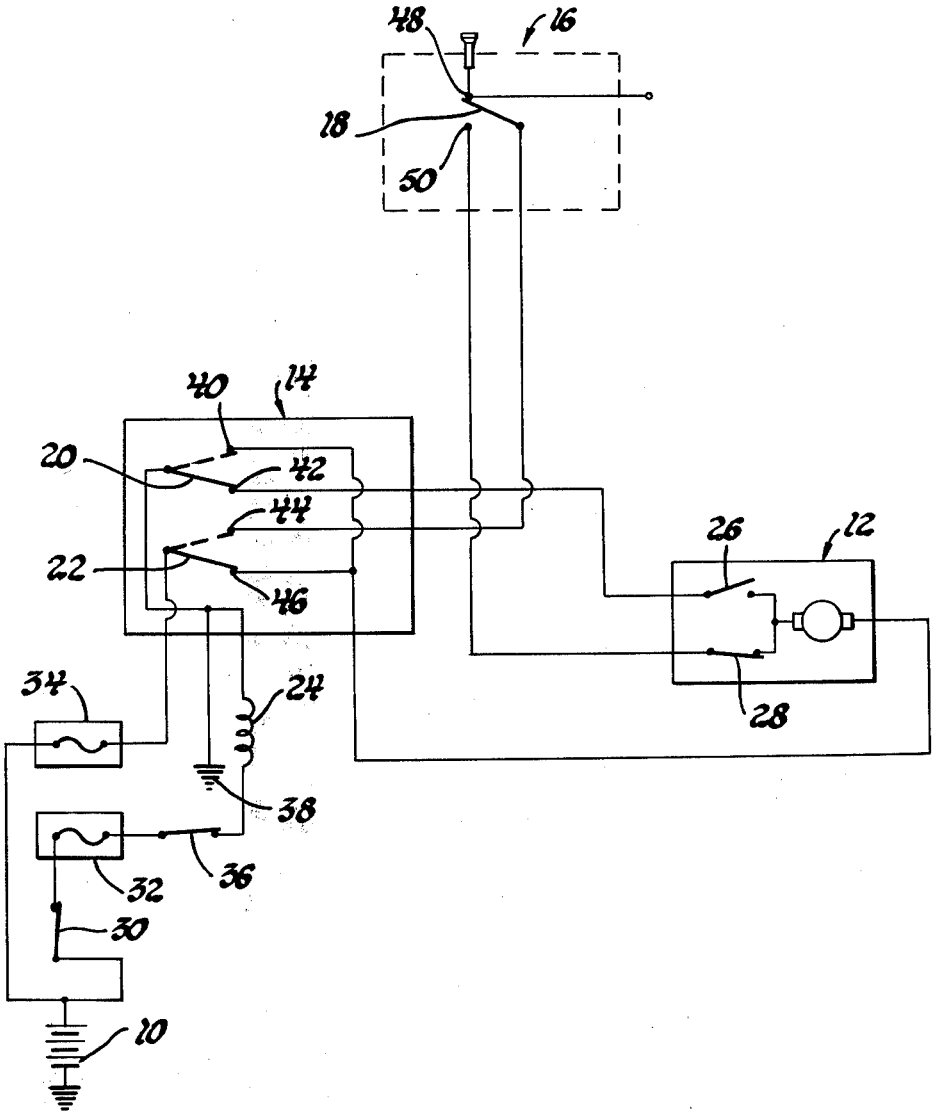
48
16
18
50
40
14
20
42
44
22
46
26
12
28
34
24
38
36
32
30
10

CONTROL FOR AN ELECTRIC MOTOR-DRIVEN TELESCOPING RADIO ANTENNA

This invention relates to telescoping vehicle antennas and more particularly to automatically controlled telescoping antennas.

There are presently available two basic forms of telescoping antenna controls. One of these controls is effective to expand and retract the antenna each time the ignition switch is turned to the on position or off position assuming the radio switch is on. The antenna will also retract automatically if the radio switch is turned off while the ignition is on and vice versa. This type of antenna control operates the electric drive motor more often than necessary. With this type of control the antenna is retracted while the ignition is turned off and extended whenever the ignition is turned on. Thus, when the vehicle is parked in a location where it is not necessary to have the antenna out of sight, for example, in one's private garage, the antenna is retracted anyway.

The other type of control is a manual switch control which is operated to extend the antenna or retract the antenna each time such operation is desired. This, of course, requires the operator to remember to operate the switch to retract the antenna whenever it is desirable to have the antenna displaced out of sight.

The present invention provides for controlling a vehicle radio antenna to be automatically extended whenever the ignition and radio switches are turned on and retracted whenever a vehicle protection mechanism is actuated and one or both of the ignition and radio switches are off.

In the preferred embodiment, the retraction switch is interconnected with or operable by the driver's side door lock of the vehicle such that when the ignition and/or radio switch is off and the operator leaves the vehicle locking the door behind him, the radio antenna will be retracted and hidden from view.

It is an object of this invention to provide an improved vehicle antenna control where the antenna will be retracted when the operator desires security for the vehicle and antenna.

It is another object of this invention to provide an improved vehicle radio antenna control wherein the antenna extension is controlled by the radio and ignition switches and the antenna retraction is controlled by a switch responsive to vehicle door locking mechanism.

These and other objects and advantages of the present invention will be more apparent from the following description and drawing which is a schematic representation of the antenna drive motor control.

The system consists of a battery 10, an electric motor 12, which drives a conventional antenna system such as that shown in U.S. Pat. No. 3,253,799, issued to R. L. Till on May 31, 1966, a motor control, generally designated 14, and a door lock, generally designated 16. The door lock 16 may be any of the conventional door lock mechanisms currently available and may either be manually operated or electrically operated. A switch 18 is added to the door lock mechanism at any convenient location such that the switch 18 will be opened when the door lock is in the unlocated position and will be closed when the door lock is in the down or locked position. The door lock in the drawing is shown in the unlocked position.

The motor control 14 consists of a pair of relay switches 20 and 22 which are controlled by a relay coil 24. This is a conventional motor relay control in that when the relay coil 24 is energized, the switches 20 and 22 are in the position shown and when the relay coil 24 is deenergized, the switches move to the other operative position, shown by dashed lines.

The motor 12 which drives the antenna has associated therewith an uplimit switch 26 and a downlimit switch 28. The use of limit switches and antenna controls is well known. The uplimit switch 26 opens when the antenna has been fully extended, and closes when the antenna is retracted; while the downlimit switch 28 opens when the antenna is fully retracted and closes when the antenna is extended.

The battery 10 is connected through a conventional ignition switch 30 to a conventional fuse block 32 and also to a second conventional fuse block 34. The fuse block 34 is connected to the switch 22. The fuse block 32 is connected to the radio switch designated 36 which in turn is connected through the relay coil 24 to ground at 38. The switch 20 is connected to ground and has two contacts 40 and 42 which are connected to the motor 12 and the uplimit switch 26, respectively. The switch 22 has two contacts 44 and 46 which are connected to the switch 18 and to the motor 12, respectively. It will be appreciated that switch contacts 40 and 46 are electrically interconnected as shown. The switch 18 has two contacts 48 and 50. Contact 48 is nonconductive and contact 50 is connected to the downlimit switch 28. The uplimit switch 26 and downlimit switch 28 are both connected to the motor 12.

The control circuit is shown with the ignition switch 30 and the radio on-off switch 36 both closed or in the electrically conductive position and the uplimit switch 26 and the switch 18 each in electrically nonconductive position, such that the antenna is in the fully extended position. In the condition shown, the relay coil 24 is energized which energizes the relay switches 20 and 22 to the position shown so that the battery 10 is connected to fuse 34 and switch 22 to the motor 12. However, the current cannot flow through the motor 12 since the uplimit switch 26 is open and the downlimit switch 28 is connected to an open contact 50 on switch 18. Thus, the antenna will stay in the extended position. If the ignition switch 30 or the radio switch 36 should be moved to the electrically nonconductive position, the relay coil 24 will be deenergized permitting the switches 20 and 22 to move to the dashed position. In this position, the battery is connected through fuse block 34 to switch 22 which is connected through contact 44 to contact 48 of the switch 18. Since the contact 48 is always nonconductive, there can be no current flow. Thus, the antenna will remain in the extended position.

With either the ignition switch 30 or radio switch 36 moved to the off or nonconductive position, and the switch 18 moved to the on or conductive position, wherein it will engage contact 50, the relay coil 24 is deenergized such that the battery 10 is connected through fuse block 34 to switch 22 which is connected through contact 44 with switch 18 and therefore to contact 50. Contact 50 is connected to the downlimit switch 28 which is closed at this time. Therefore, the motor 12 will be energized since the other side of motor 12 is connected through contact 40 and switch 20 to ground 38. Thus, the motor will run in a direction to retract the antenna. Motor operation will continue until a downlimit switch 28 is opened discontinuing operation of the motor. On retraction of the antenna, the uplimit switch 26 will be closed to condition the control system for antenna extension should that be desired when the operator returns to the vehicle and energizes both the ignition switch 30 and radio switch 36. The radio antenna will not be extended unless both the ignition switch 30 and radio switch 36 are operated to the on position after the antenna has been retracted. The antenna will be extended when both switches 30 and 36 are moved to the on position regardless of the position of door lock switch 18. As can be seen from the diagram whenever the radio and ignition switches are on, the relay coil 24 is energized such that one side of the motor 12 is connected to the battery through switch 22 and the other side is connected to ground through the closed uplimit switch 26 and switch 20.

Obviously, many modifications and variations are possible in light of the above teaching. It is therefore to be understood that within the scope of the appended claims, the invention may be practiced otherwise than as specifically described.

The embodiments of the invention in which an exclusive property or privilege is claimed are defined as follows:

1. Electric control for an electric motor driven radio antenna for use in a vehicle having a selectively actuatable mechanism for protecting the vehicle from unauthorized entry, said control comprising electric motor control means for directing electric power to the electric motor to move said antenna to an extended or retracted position, vehicle ignition switch means and a radio control switch means in electrical series relation for conditioning said electric motor control means to energize said electric motor to extend said antenna only when both switch means are conditioned to be electrically conductive; and retraction switch means automatically operable by said selectively actuatable mechanism to energize said electric motor, through said electric motor control means, to retract said antenna only when said selectively actuatable mechanism is operated to protect the vehicle and either or both of said vehicle ignition switch means or said radio control switch means are conditioned to be electrically nonconductive.

* * * * *